US010260838B1

(12) United States Patent
Kincel et al.

(10) Patent No.: US 10,260,838 B1
(45) Date of Patent: Apr. 16, 2019

(54) FIREARM HANDGUARD

(71) Applicant: Bravo Company MFG, Inc., Hartland, WI (US)

(72) Inventors: Eric Stephen Kincel, Las Vegas, NV (US); Jeffrey James O'Brien, Las Vegas, NV (US)

(73) Assignee: Bravo Company MFG, Inc., Hartland, WI (US)

( * ) Notice: Subject to any disclaimer, the term of this patent is extended or adjusted under 35 U.S.C. 154(b) by 186 days.

(21) Appl. No.: 15/299,391

(22) Filed: Oct. 20, 2016

(51) Int. Cl.

| | |
|---|---|
| ***F41A 17/00*** | (2006.01) |
| ***F41C 23/16*** | (2006.01) |
| ***F41C 23/18*** | (2006.01) |
| ***F41G 11/00*** | (2006.01) |

(52) U.S. Cl.
CPC ..... *F41C 23/16* (2013.01); *F41C 23/18* (2013.01); *F41G 11/003* (2013.01)

(58) Field of Classification Search
CPC ..... F41C 23/16; F41C 23/18
USPC ..... 42/71.01
See application file for complete search history.

(56) References Cited

U.S. PATENT DOCUMENTS

| | | | |
|---|---|---|---|
| 2,078,010 | A | 4/1937 | Meepos |
| 2,102,964 | A | 12/1937 | Mosseberg |
| 3,066,375 | A | 12/1962 | Knowles et al. |
| 3,177,587 | A | 4/1965 | Hart |
| 3,512,653 | A | 5/1970 | Erismann |
| 3,559,940 | A | 2/1971 | Kruzell |
| 3,798,818 | A | 3/1974 | Casull |
| 3,844,627 | A | 10/1974 | Gutner |
| 3,861,070 | A | 1/1975 | Wild et al. |
| 4,167,884 | A | 9/1979 | Santanna |
| 4,663,875 | A | 5/1987 | Tatro |
| 4,905,396 | A | 3/1990 | Bechtel |
| 4,959,908 | A | 10/1990 | Weyrauch |
| 5,078,215 | A | 1/1992 | Nau |
| 5,590,484 | A | 1/1997 | Mooney et al. |
| 5,603,594 | A | 2/1997 | Lincoln |
| 5,632,108 | A | 5/1997 | Ruger et al. |
| 6,609,321 | B2 | 8/2003 | Faifer |

(Continued)

FOREIGN PATENT DOCUMENTS

| | | |
|---|---|---|
| EP | 1832835 | 9/2007 |
| WO | 2013010515 | 1/2013 |

OTHER PUBLICATIONS http://b5systems.com/keymod-hand-guard-mid-length/, Dec. 20, 2016, 2 pages.

(Continued)

*Primary Examiner* — J. Woodrow Eldred
(74) *Attorney, Agent, or Firm* — Michael Best & Friedrich LLP

(57) ABSTRACT

A firearm handguard is disclosed. The handguard comprises a first side section, a second side section coupled to the first side section by a plurality of interlocking fingers, and a bottom section coupled to the first side section and the second side section. The first side section and the second side section each contain at least one accessory mounting aperture. The first side section and the second side section are comprised of a polymer material having molded therein a reinforcement liner including at least one reinforcement aperture. The at least one accessory mounting aperture is aligned with the at least one reinforcement aperture.

22 Claims, 17 Drawing Sheets

(56) References Cited

U.S. PATENT DOCUMENTS

| | | | |
|---|---|---|---|
| 6,836,990 | B2 | 1/2005 | Shiloni |
| 6,874,269 | B2 | 4/2005 | Chen et al. |
| 7,216,451 | B1 | 5/2007 | Troy |
| 7,325,352 | B2 | 2/2008 | Matthews et al. |
| 7,430,829 | B2 | 10/2008 | Murello |
| 7,464,495 | B2 | 12/2008 | Cahill |
| D613,811 | S | 4/2010 | Swan |
| 7,712,242 | B2 | 5/2010 | Matthews et al. |
| 7,716,865 | B2 | 5/2010 | Daniel et al. |
| 7,770,317 | B1 | 8/2010 | Tankersley |
| 7,793,452 | B1 | 9/2010 | Samson et al. |
| D636,453 | S | 4/2011 | Fitzpatrick et al. |
| D641,450 | S | 7/2011 | Ding |
| 7,971,384 | B2 | 7/2011 | Lippard |
| 8,006,430 | B2 | 8/2011 | Wang |
| 8,051,595 | B2 | 11/2011 | Hochstrate et al. |
| 8,141,289 | B2 | 3/2012 | Gomez et al. |
| 8,201,353 | B1 | 6/2012 | Swan |
| 8,245,428 | B2 | 8/2012 | Griffin |
| 8,312,668 | B2 | 11/2012 | Kincel |
| 8,438,770 | B2 | 5/2013 | Troy |
| 8,490,316 | B2 | 7/2013 | Kincel et al. |
| 8,539,708 | B2 | 9/2013 | Kenney et al. |
| 8,578,647 | B2 | 11/2013 | Storch et al. |
| 8,607,490 | B1 | 12/2013 | Zinsner |
| D703,286 | S | 4/2014 | Chen et al. |
| 8,739,448 | B2 | 6/2014 | Kimmel et al. |
| 8,752,320 | B2 | 6/2014 | Masters |
| D710,964 | S | 8/2014 | Chvala |
| 8,819,980 | B2 | 9/2014 | Geissele |
| D717,907 | S | 11/2014 | Montes |
| D717,908 | S | 11/2014 | Montes |
| D720,421 | S | 12/2014 | Chen |
| 8,904,691 | B1 | 12/2014 | Kincel |
| D721,407 | S | 1/2015 | Chu |
| 8,925,236 | B1 | 1/2015 | Mayberry et al. |
| D722,356 | S | 2/2015 | Keller et al. |
| D725,723 | S | 3/2015 | Eddie |
| 9,103,625 | B2 | 8/2015 | Masters |
| 9,157,697 | B2 | 10/2015 | Leclair |
| D744,054 | S | 11/2015 | Peterson et al. |
| D746,399 | S | 12/2015 | Folkestad, II et al. |
| D746,936 | S | 1/2016 | Huang |
| 9,239,209 | B2 | 1/2016 | Mayberry et al. |
| 9,239,210 | B2 | 1/2016 | Mayberry et al. |
| D749,181 | S | 2/2016 | Hu |
| 9,297,599 | B2 | 3/2016 | Underwood et al. |
| 9,303,949 | B1 | 4/2016 | Oglesby |
| D755,338 | S | 5/2016 | Slank |
| D757,201 | S | 5/2016 | Meier |
| D757,204 | S | 5/2016 | Chow et al. |
| D757,878 | S | 5/2016 | Barfoot et al. |
| 9,377,274 | B2 | 6/2016 | Kincel |
| 9,383,163 | B2 | 7/2016 | Kincel et al. |
| 9,389,043 | B1 | 7/2016 | Zhang |
| 9,429,388 | B2 | 8/2016 | Mayberry et al. |
| D768,800 | S | 10/2016 | Willits |
| 9,459,078 | B1 | 10/2016 | Kincel |
| 9,464,865 | B2 | 10/2016 | Shea et al. |
| 9,470,472 | B2 | 10/2016 | Kincel et al. |
| 9,476,672 | B2 | 10/2016 | Wells et al. |
| D771,216 | S | 11/2016 | Dubois |
| 9,523,554 | B2 | 12/2016 | Mayberry et al. |
| D779,013 | S | 2/2017 | Cheng et al. |
| D779,014 | S | 2/2017 | Cheng et al. |
| 9,581,412 | B2 | 2/2017 | Cheng et al. |
| 9,599,439 | B1 | 3/2017 | Sylvester |
| D783,760 | S | 4/2017 | Pavlick |
| D783,761 | S | 4/2017 | Pavlick |
| D785,743 | S | 5/2017 | Pavlick |
| 9,696,112 | B2 | 7/2017 | Gottzmann et al. |
| 9,709,358 | B2 | 7/2017 | Kincel |
| D795,986 | S | 8/2017 | Frederickson et al. |
| 9,791,239 | B1 | 10/2017 | Kincel et al. |
| 2001/0045046 | A1 | 11/2001 | Otteman |
| 2004/0009034 | A1 | 1/2004 | Miller |
| 2005/0268513 | A1 | 12/2005 | Battaglia |
| 2006/0191183 | A1 | 8/2006 | Griffin |
| 2008/0092422 | A1 | 4/2008 | Daniel et al. |
| 2008/0301994 | A1* | 12/2008 | Langevin ..... F41C 23/16 42/71.01 |
| 2009/0000175 | A1 | 1/2009 | Potterfield et al. |
| 2009/0100734 | A1 | 4/2009 | Swan et al. |
| 2009/0178325 | A1 | 7/2009 | Veilleux |
| 2010/0122485 | A1 | 5/2010 | Kincel |
| 2010/0242332 | A1 | 9/2010 | Teetzel et al. |
| 2010/0319231 | A1 | 12/2010 | Stone et al. |
| 2011/0032694 | A1 | 2/2011 | Swan et al. |
| 2011/0126443 | A1 | 6/2011 | Sirois |
| 2011/0192066 | A1 | 8/2011 | Kimmel et al. |
| 2012/0042557 | A1 | 2/2012 | Gomez et al. |
| 2012/0097807 | A1 | 4/2012 | Rees |
| 2012/0124880 | A1 | 5/2012 | Leclair |
| 2012/0167434 | A1 | 7/2012 | Masters |
| 2012/0180359 | A1 | 7/2012 | Fitzpatrick et al. |
| 2012/0186123 | A1 | 7/2012 | Troy et al. |
| 2012/0311908 | A1 | 12/2012 | Kenney et al. |
| 2013/0031820 | A1 | 2/2013 | Deros |
| 2013/0036646 | A1 | 2/2013 | Rubac et al. |
| 2013/0104441 | A1 | 5/2013 | Kincel |
| 2013/0133238 | A1 | 5/2013 | Quetschke |
| 2013/0276341 | A1 | 10/2013 | Wells et al. |
| 2013/0318848 | A1 | 12/2013 | Kincel |
| 2014/0000142 | A1 | 1/2014 | Patel |
| 2014/0026459 | A1 | 1/2014 | Yan et al. |
| 2014/0041273 | A1 | 2/2014 | Masters |
| 2014/0082990 | A1* | 3/2014 | Lee ..... F41A 21/24 42/96 |
| 2014/0115938 | A1 | 5/2014 | Jarboe |
| 2014/0115939 | A1 | 5/2014 | Troy et al. |
| 2014/0115940 | A1 | 5/2014 | Bonelli et al. |
| 2014/0130390 | A1 | 5/2014 | Geissele |
| 2014/0204566 | A1 | 7/2014 | Kay |
| 2014/0373419 | A1 | 12/2014 | Leclair |
| 2015/0000171 | A1 | 1/2015 | Roberts |
| 2015/0198408 | A1 | 7/2015 | Kincel et al. |
| 2015/0219422 | A1 | 8/2015 | Kincel |
| 2015/0267993 | A1 | 9/2015 | Cheng et al. |
| 2015/0285583 | A1 | 10/2015 | Mayberry et al. |
| 2015/0285584 | A1 | 10/2015 | Mayberry et al. |
| 2015/0285585 | A1 | 10/2015 | Hewes et al. |
| 2015/0316347 | A1 | 11/2015 | Shea et al. |
| 2015/0369555 | A1 | 12/2015 | Daniel et al. |
| 2015/0369558 | A1 | 12/2015 | Gottzmann |
| 2016/0010946 | A1 | 1/2016 | Gibbons et al. |
| 2016/0025120 | A1 | 1/2016 | Swan et al. |
| 2016/0091277 | A1 | 3/2016 | Mayberry et al. |
| 2016/0169617 | A1 | 6/2016 | Daley, Jr. |
| 2016/0187100 | A1 | 6/2016 | Mayberry et al. |
| 2016/0349011 | A1 | 12/2016 | Jen |
| 2017/0016695 | A1 | 1/2017 | Willits |
| 2017/0067718 | A1 | 3/2017 | Mayberry et al. |
| 2017/0205183 | A1 | 7/2017 | Ding et al. |
| 2017/0261276 | A1 | 9/2017 | Morris |
| 2017/0307328 | A1 | 10/2017 | Shelton et al. |
| 2018/0023919 | A1 | 1/2018 | Kincel et al. |

OTHER PUBLICATIONS http://www.recoilweb.com/b5-systems-color-wheels-39707.html, Dec. 20, 2016, 4 pages.
http://www.evike.com/images/large/HG_MP_PTSMOE2.jpg, Dec. 20, 2016, 1 page.
http://ww.evike.com/products/30805/, Dec. 20, 2016, 3 pages.
Co-pending U.S. Appl. No. 15/885,071, filed Jan. 21, 2018.
Co-pending U.S. Appl. No. 29/581,693, filed Oct. 20, 2016.
Co-pending U.S. Appl. No. 15/788,720, filed Oct. 19, 2017.

* cited by examiner

FIREARM HANDGUARD

TECHNICAL FIELD

The present invention generally concerns firearm equipment. More particularly, the present invention relates to a firearm handguard.

BACKGROUND OF THE INVENTION

The two-piece, non-aluminum handguard design was first prototyped for early AR-10s, after which the first AR-15 designs utilized a two-piece handguard system made of Bakelite-type material (early synthetic plastics). These two-piece handguard systems utilized two side halves rather than a top-half and bottom-half design. The first two-piece handguards with a top and bottom design was introduced with the CAR-15, also known as the XM-177/GAU-5 series carbine. This design led to the two-piece handguards for the M16A2 rifle in the 1980s.

Since the introduction of these earlier handguards, a number of manufacturers have developed improved polymer handguards. For example, many modern equivalents of those early handguards offer ergonomics (for the forward gripping hand) and mounting interfaces for firearm accessories. With traditional handguard systems, it was difficult to incorporate both of these advantageous features because the only mounting interface that was available was the Military Standard 1913 Picatinny rail. The Picatinny rail is considered by many to be extremely uncomfortable to handle, unless the railed areas are covered with rail panels. With rail panels installed, however, the overall size of the handguard is too large. To solve this problem, two-piece handguards were developed that utilize a different accessory mounting interfaces. Examples include the KeyMod handguard by B5 and the MOE handguard by Magpul.

Most polymer handguards are injection-molded and manufactured in two pieces, including an upper half and a lower half. Although injection molding is a preferred method of manufacture because it is relatively inexpensive, precise, and versatile, polymer materials are weaker than the traditional aluminum handguard.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

SUMMARY OF THE INVENTION

In one embodiment of the present invention, a firearm handguard is disclosed. The handguard comprises a first side section, a second side section coupled to the first side section by a plurality of interlocking fingers, and a bottom section coupled to the first side section and the second side section. The first side section and the second side section each contain at least one accessory mounting aperture. The first side section and the second side section are comprised of a polymer material having molded therein a reinforcement liner including at least one reinforcement aperture. The at least one accessory mounting aperture is aligned with the at least one reinforcement aperture.

In an alternate embodiment of the present invention, a firearm is disclosed. The firearm includes an upper receiver and a handguard coupled to the upper receiver. The handguard comprises a first side section, a second side section coupled to the first side section by a plurality of interlocking fingers, and a bottom section coupled to the first side section and the second side section. The first side section and the second side section each contain at least one accessory mounting aperture. The first side section and the second side section are comprised of a polymer material having molded therein a reinforcement liner including at least one reinforcement aperture. The at least one accessory mounting aperture is aligned with the at least one reinforcement aperture.

In yet another embodiment of the present invention, a firearm handguard is disclosed. The firearm handguard includes a plurality of molded polymer sections. A first section of the plurality of molded polymer sections includes a reinforcement liner and an accessory mounting aperture.

DETAILED DESCRIPTION OF THE INVENTION

With reference to the drawings and in operation, the present invention overcomes at least some of the disadvantages of known handguards. The present invention introduces a three-piece, injection-molded handguard design with an added metal reinforcement liner.

Embodiments of the present invention provide a handguard assembly and system and method of mounting the assembly to a firearm. Persons of ordinary skill in the art will realize that the following description of the presently invention is illustrative only and not in any way limiting. Other embodiments of the invention will readily suggest themselves to such skilled persons.

Figure 1A:
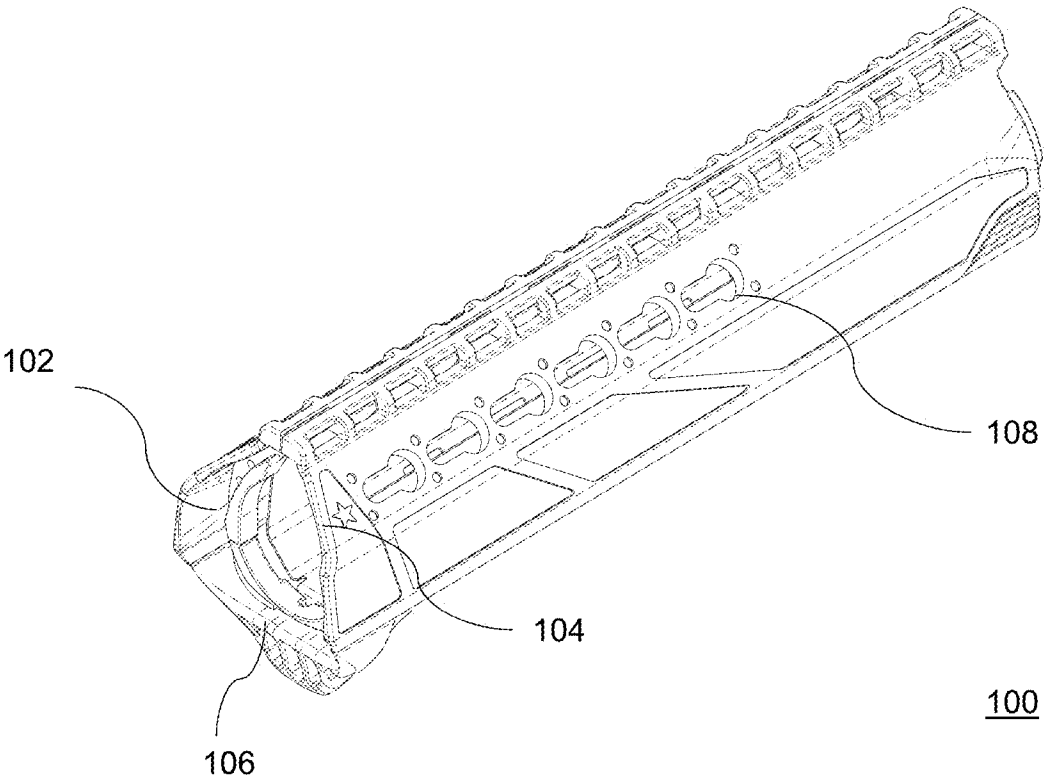
FIG. 1A illustrates a perspective view of an exemplary handguard according to a first embodiment.

Referring now to FIG. 1A, illustrating a perspective view of an exemplary handguard according to a first embodiment, a handguard 100 is comprised of a first side section 102, a second side section 104, and a bottom section 106.

It is contemplated that any handguard assembly system may be used in connection with the present invention to mount the handguard to the firearm. In a preferred embodiment, the assembly system disclosed in U.S. Pat. No. 8,904,691 entitled "Firearm Handguard Assembly", issued to Eric Kincel on Dec. 9, 2014, and incorporated herein by reference, is used (not shown).

It is also contemplated that the handguard may contain any suitable accessory mounting interface, including, without limitation, a KeyMod interface, a Picatinny rail, an M-LOK interface (by Magpul), a GAMA System interface (by Gibbz Arms), or any combination thereof, though no accessory mounting interface is required for the handguard to function in connection with the present invention. The handguard of the present invention may additionally or alternatively include apertures of any shape or size simply for ventilation. Referring again to FIG. 1A, handguard 100 includes exemplary KeyMod apertures, one of which is labeled 108.

Figure 1B:
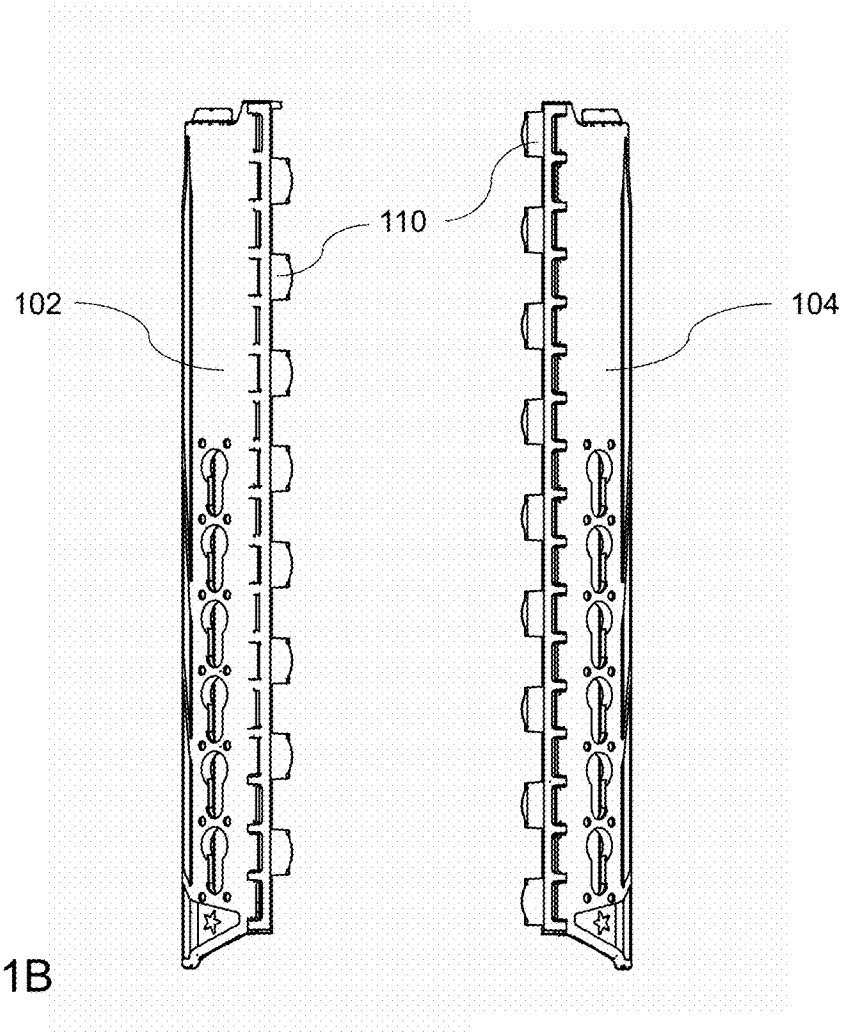
FIG. 1B illustrates a top view of the side sections of the handguard of FIG. 1A.

Referring now to FIG. 1B, illustrating a top view of side sections of the handguard of FIG. 1A, first side section 102 and second side section 104 each contains a plurality of interlocking fingers, two of which are labeled 110. Interlocking fingers 110 may be aligned and snapped into place by applying downward force, such that first section 102 and second section 104 are in a locked position. By applying outward pressure to the bottom of each of first side section 102 and second side section 104 and pulling in opposition directions, interlocking fingers 110 may be easily disconnected, placing first side section 102 and second side section 104 into an unlocked position for maintenance or service.

Figure 1C:
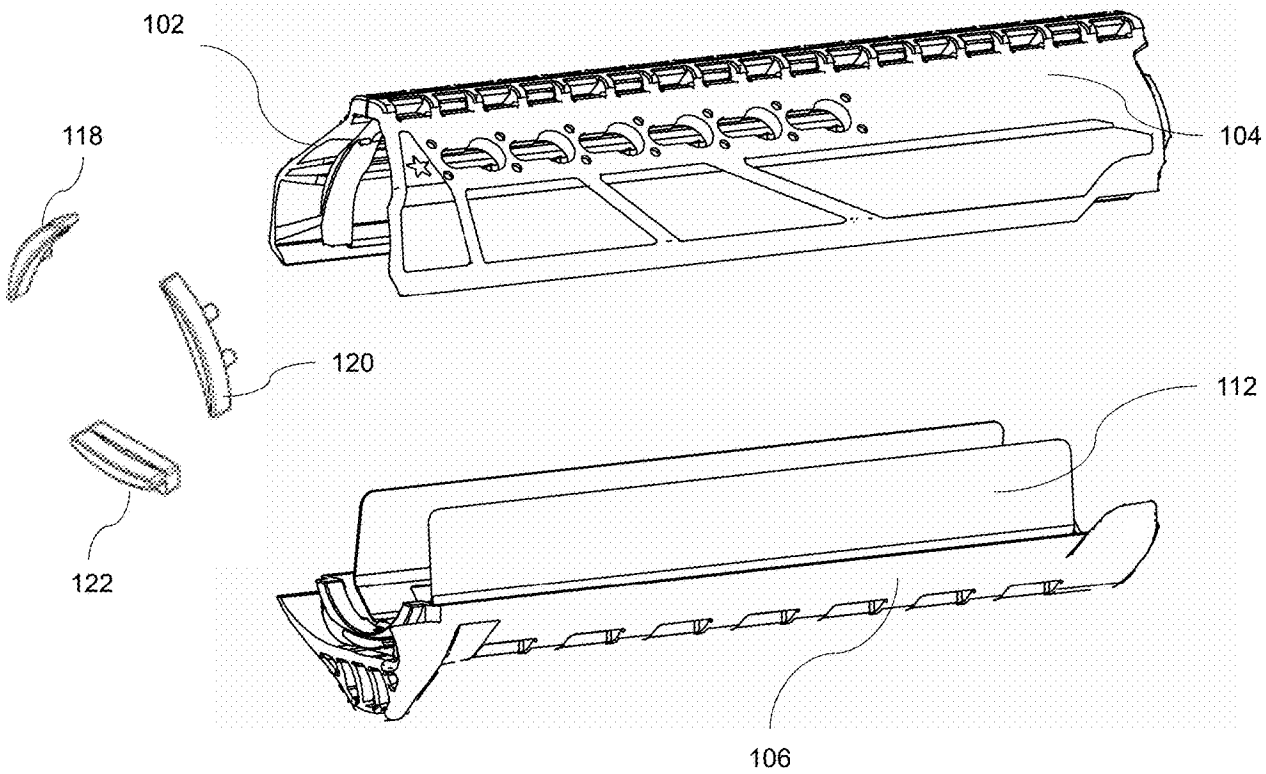
FIG. 1C illustrates an exploded perspective view of the assembled side sections and the bottom section of the handguard of FIG. 1A.

Referring now to FIG. 1C, illustrating a perspective view of the handguard of FIG. 1A, first side section 102 and second side section 104 are shown in an assembled (locked) position. Bottom section 106 includes heat shield 112. First handguard insert 118, second handguard insert 120, and third handguard insert 122 are also shown (described in more detail below with reference to FIG. 1G and FIG. 5).

Figure 1D:
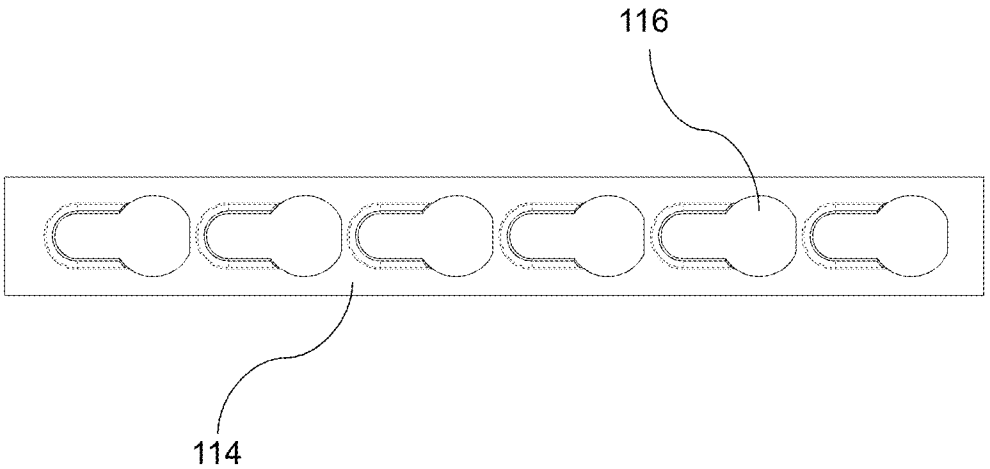
FIG. 1D illustrates a side view of a reinforcement liner for use in the handguard of FIG. 1A.

Reaming now to FIG. 1D, a reinforcement liner for use in the handguard of FIG. 1A is shown. Reinforcement liner 114 is molded into the polymer material of handguard 100, which provides additional strength to the accessory mounting interface (e.g., the KeyMod interface of FIG. 1A) that normal polymer material would not provide on its own. Reinforcement liner 114 may be made of metal, such as stainless steel, aluminum, or titanium. Reinforcement liner 114 may also be made of any other suitably durable material, such as but not limited to fiber reinforced polymers, etc. During the injection molding process, reinforcement liner 114 may be hand-loaded into each of the first side section 102 and second side section 104, which allows for a straight-shot injection molding process. Reinforcement liner 114 may include a plurality of apertures, such as KeyMod apertures, one of which is labeled 116.

Figure 1E:
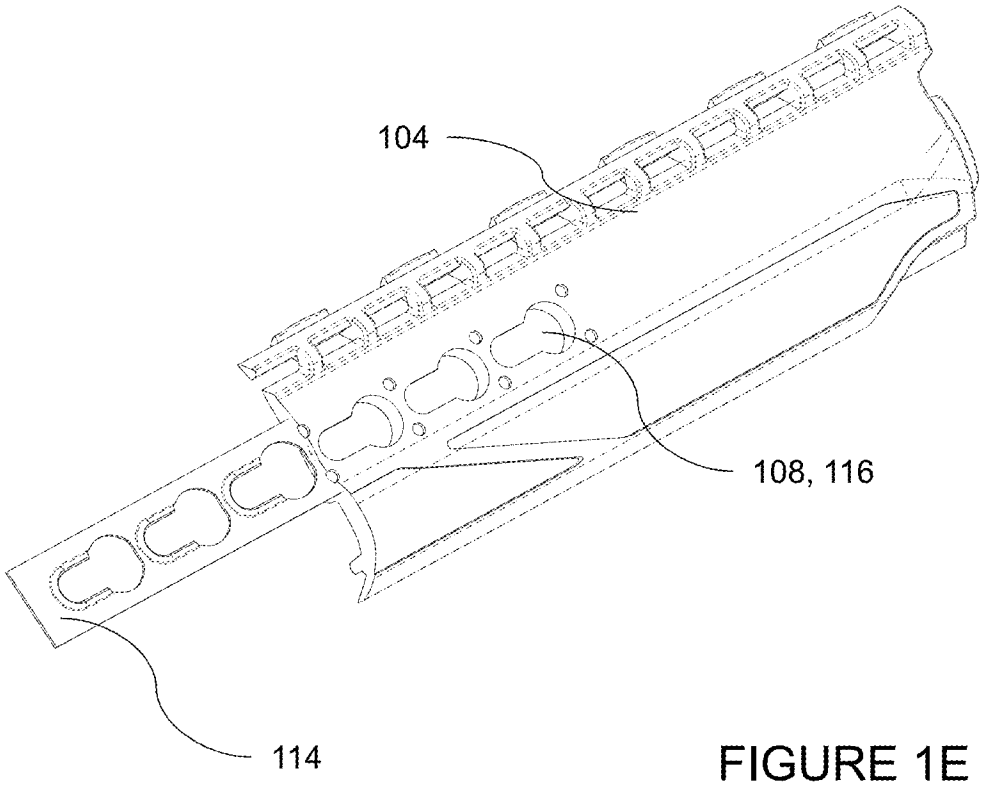
FIG. 1E illustrates a cutaway view of a side section with reinforcement liner of the handguard of FIG. 1A.

Referring now to FIG. 1E, a cutaway view of a side section with reinforcement liner of the handguard of FIG. 1A is shown. Reinforcement liner 114 is molded into second side section 104. Apertures 116 of reinforcement liner 114 align with KeyMod apertures 108. Optionally, reinforcement liner 114 may include additional apertures, other than accessory-mounting apertures, around its perimeter to improve molding (by avoiding delamination) and reduce the weight of reinforcement liner 114.

Figure 1F:
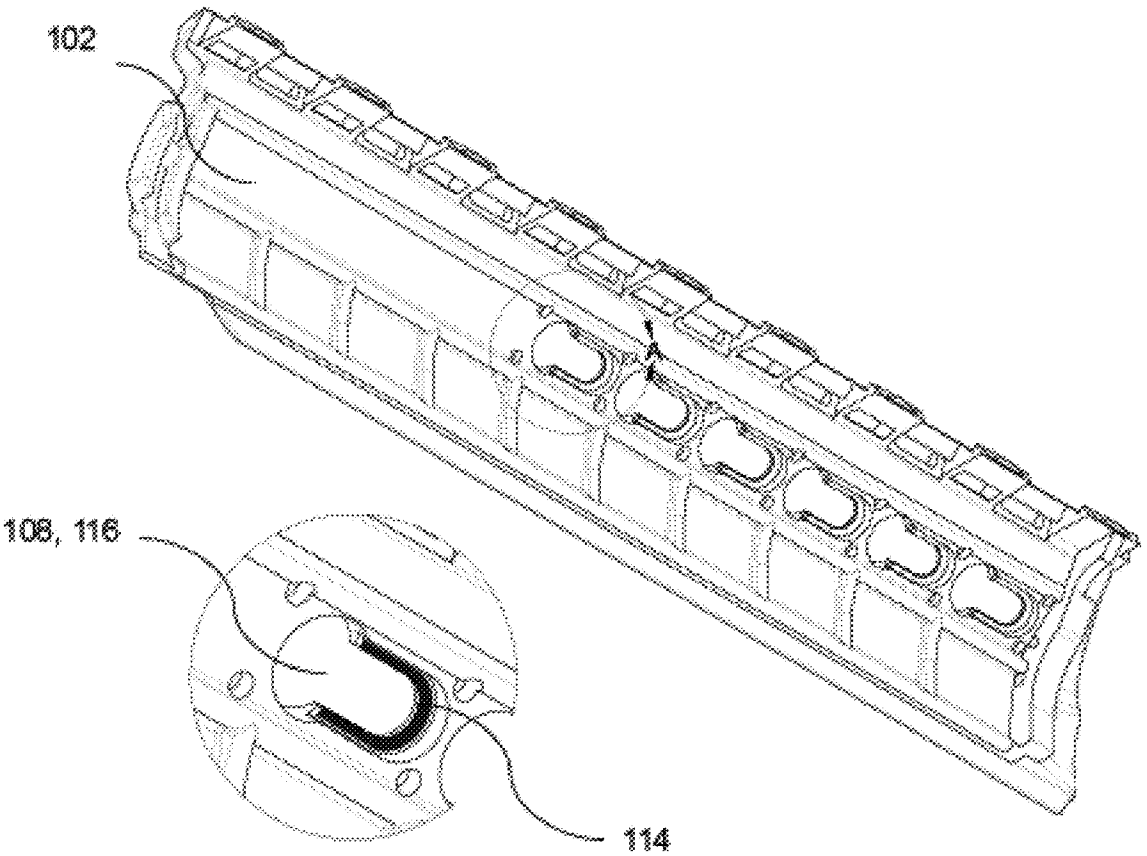
FIG. 1F illustrates a magnified view of an aperture of the handguard of FIG. 1A.

Referring now to FIG. 1F, a magnified view of an aperture of the handguard of FIG. 1A is shown. Reinforcement liner 114 (shaded) is shown in the exposed edges of KeyMod aperture 108, 116. Reinforcement liner 114 is shown in FIG. 1F as partially exposed on the interior of handguard 100 (closest to the barrel). However, it will be understood that reinforcement liner 114 could alternatively be partially exposed on the exterior of handguard 100. In yet another embodiment, no part of reinforcement liner 114 may be exposed.

Figure 1G:
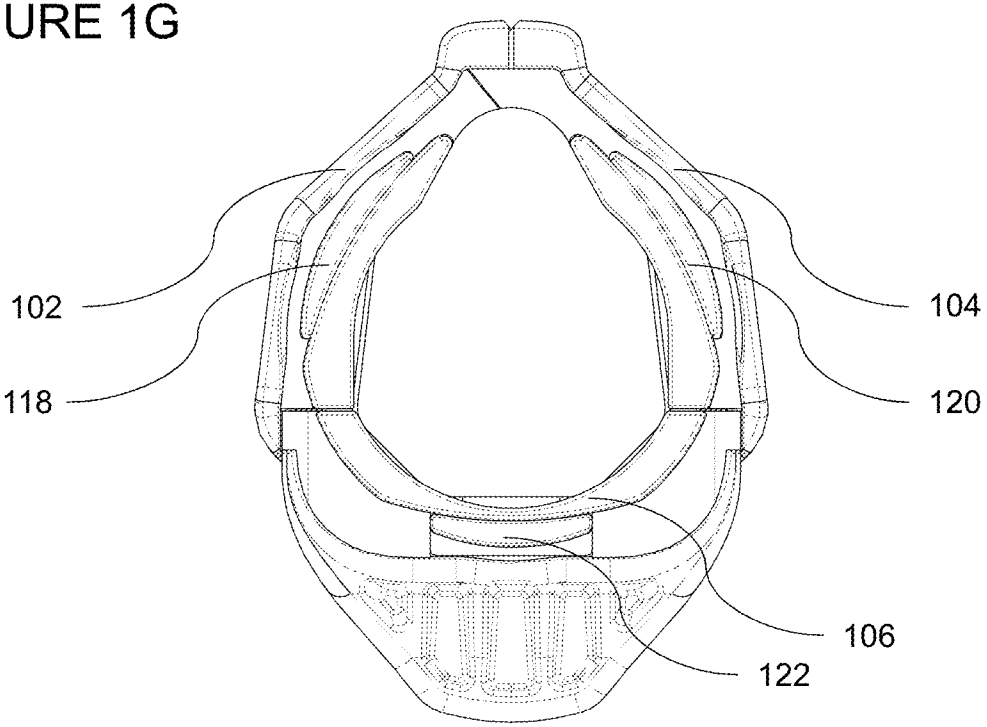
FIG. 1G illustrates a front view of the assembled handguard of FIG. 1A.

Referring now to FIG. 1G, a front view of the assembled handguard of FIG. 1A is shown. First section 102 and second section 104, in a locked position, may be mounted to bottom section 106 to complete handguard 100. Due to its triangulated structure, when handguard 100 is fully assembled and installed on a firearm (not shown, see FIG. 2), its strength rivals the strength of a one-piece handguard. When in use, first handguard insert 118 may interface with first section 102, second handguard insert 120 may interface with second section 104, and third handguard insert 122 may interface with bottom section 106. First handguard insert 118, second handguard insert 120, and third handguard insert 122 are described in more detail below with reference to FIG. 5.

Figure 2:
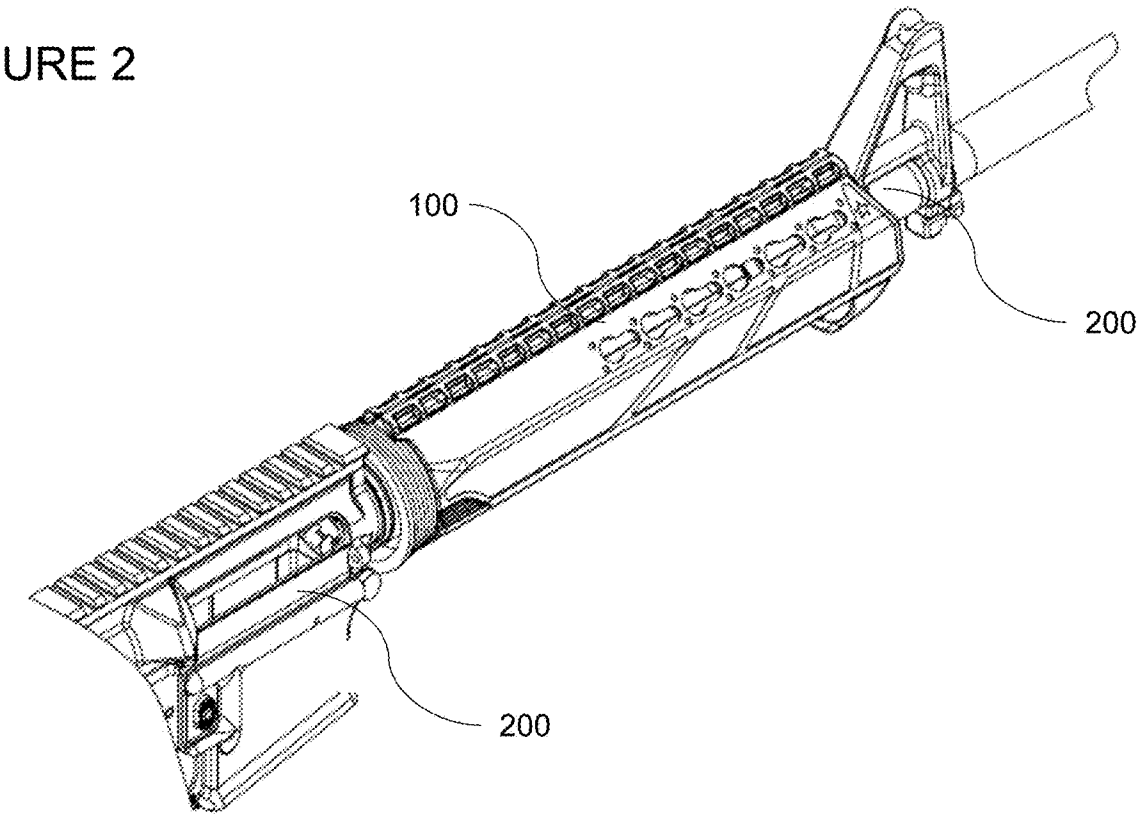
FIG. 2 illustrates a perspective view of the handguard of FIG. 1A on a cutaway view of an exemplary firearm.

Referring now to FIG. 2, a perspective view of the handguard of FIG. 1A on a cutaway view of an exemplary firearm is illustrated. Handguard 100 is fully assembled and mounted on an exemplary firearm 200. Firearm 200 may be an AR-15 with a mid-length gas system or other firearms.

Figure 3A:
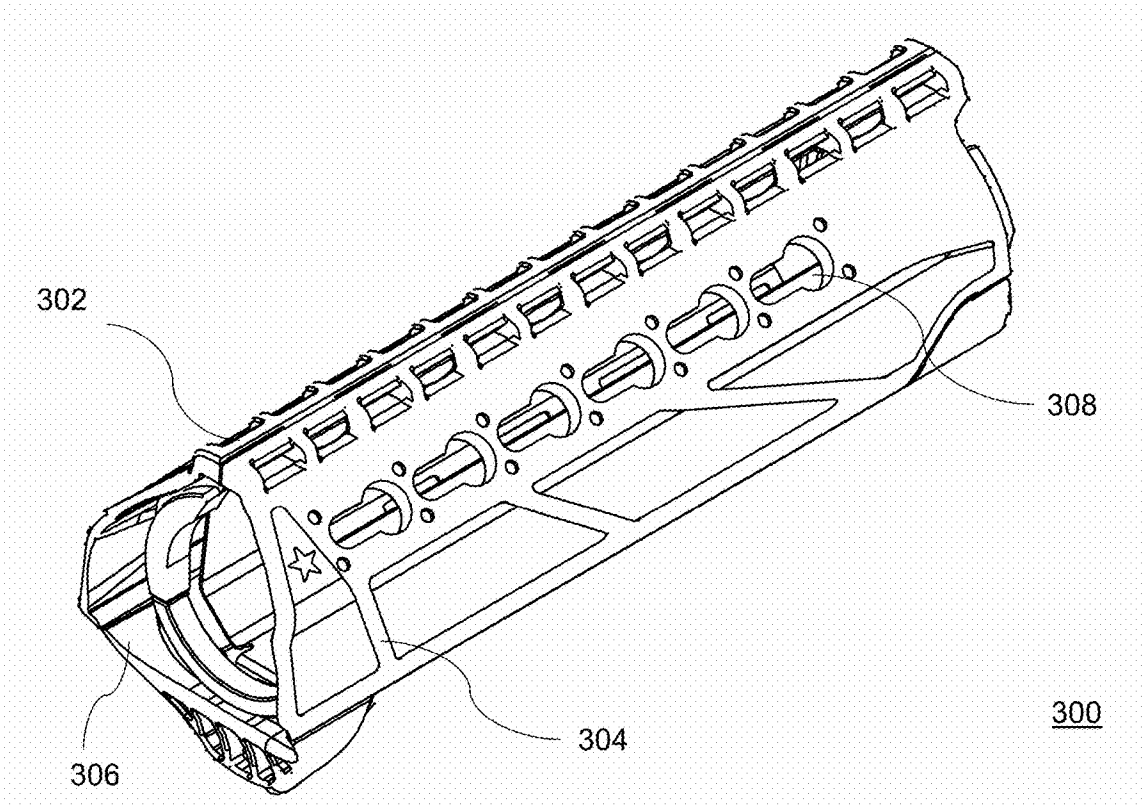
FIG. 3A illustrates a perspective view of an exemplary handguard according to a second embodiment.

Referring now to FIG. 3A, illustrating a perspective view of an exemplary handguard according to a first embodiment, a handguard 300 is comprised of a first side section 302, a second side section 304, and a bottom section 306.

It is contemplated that the handguard may contain any suitable accessory mounting interface, including, without limitation, a KeyMod interface, a Picatinny rail, an M-LOK interface (by Magpul), a GAMA System interface (by Gibbz Arms), or any combination thereof, though no accessory mounting interface is required for the handguard to function in connection with the present invention. The handguard of the present invention may additionally or alternatively include apertures of any shape or size simply for ventilation. Referring again to FIG. 3A, handguard 300 includes exemplary KeyMod apertures, one of which is labeled 308.

Figure 3B:
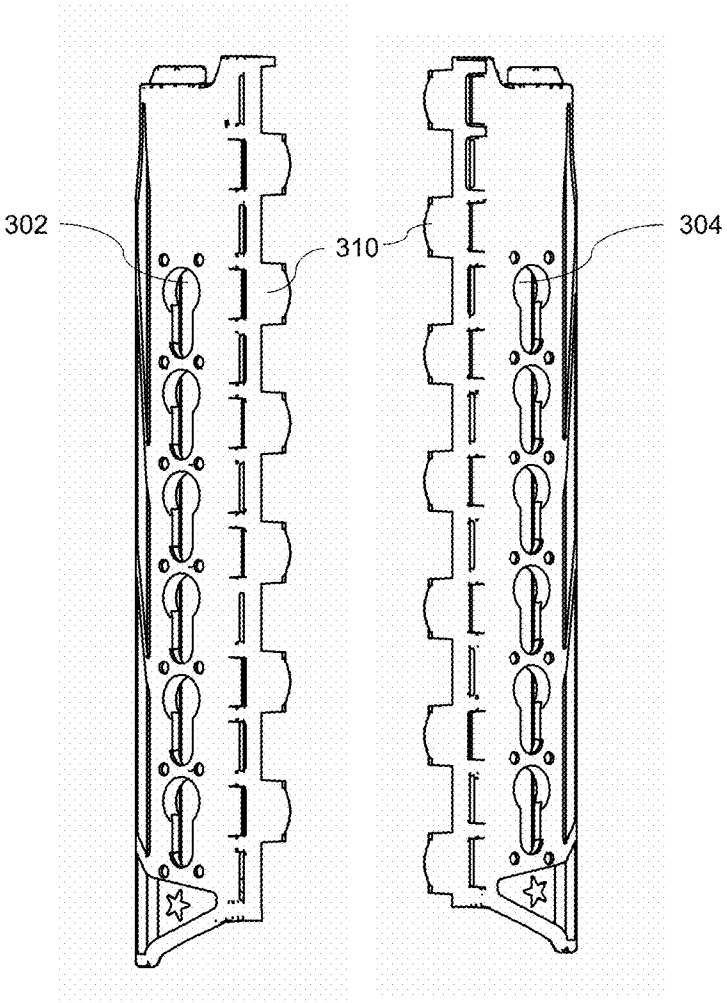
FIG. 3B illustrates a top view of the side sections of the handguard of FIG. 3A.

Referring now to FIG. 3B, illustrating a top view of side sections of the handguard of FIG. 3A, first side section 302 and second side section 304 each contains a plurality of interlocking fingers, two of which are labeled 310. Interlocking fingers 310 may be aligned and snapped into place by applying downward force, such that first section 302 and second section 304 are in a locked position. By applying outward pressure to the bottom of each of first side section 302 and second side section 304 and pulling in opposition directions, interlocking fingers 310 may be easily disconnected, placing first side section 302 and second side section 304 into an unlocked position for maintenance or service.

Figure 3C:
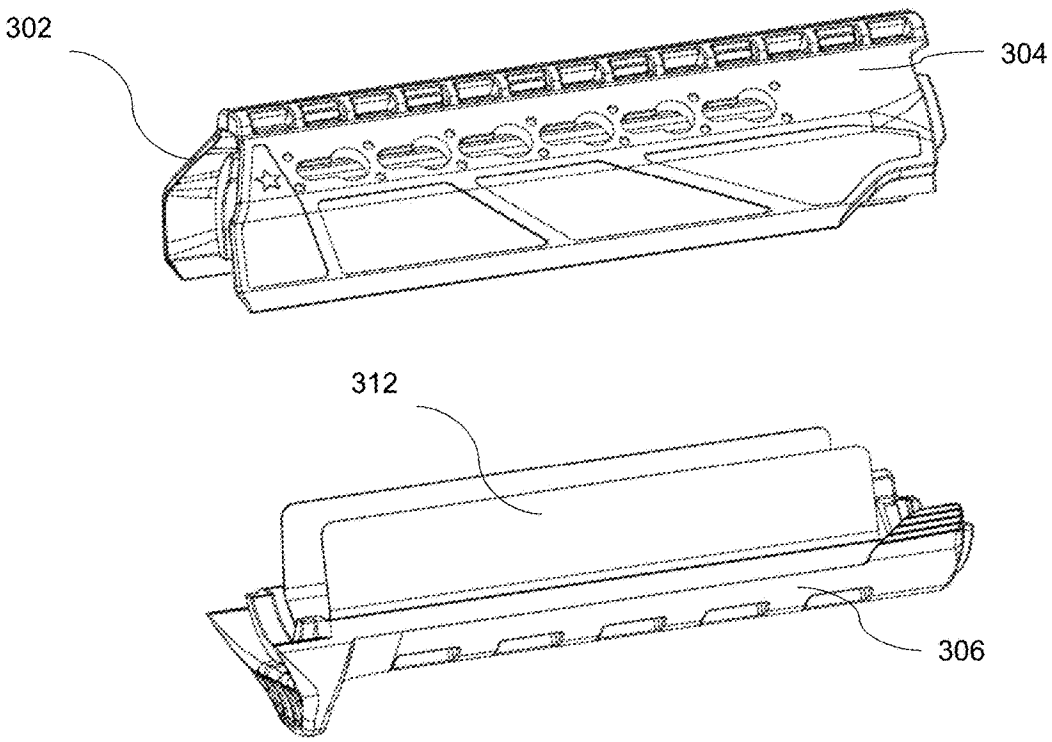
FIG. 3C illustrates an exploded perspective view of the assembled side sections and the bottom section of the handguard of FIG. 3A.

Referring now to FIG. 3C, illustrating a perspective view of the handguard of FIG. 3A, first side section 302 and second side section 304 are shown in an assembled (locked) position. Bottom section 306 includes heat shield 312.

Figure 3D:
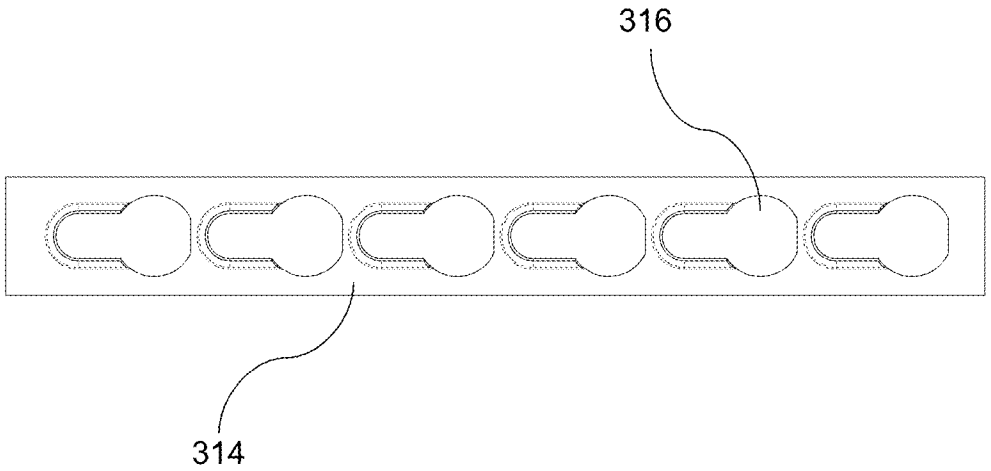
FIG. 3D illustrates a side view of a reinforcement liner for use in the handguard of FIG. 3A.

Referring now to FIG. 3D, a reinforcement liner for use in the handguard of FIG. 3A is shown. Reinforcement liner 314 is molded into the polymer material of handguard 300, which provides additional strength to the accessory mounting interface (e.g., the KeyMod interface of FIG. 3A) that normal polymer material would not provide on its own. Reinforcement liner 314 may be made of metal, such as stainless steel, aluminum, or titanium. Reinforcement liner 314 may also be made of any other suitably durable material, such as but not limited to fiber reinforced polymers, etc. During the injection molding process, reinforcement liner 314 may be hand-loaded into each of the first side section 302 and second side section 304, which allows for a straight-shot injection molding process. Reinforcement liner 314 may include a plurality of apertures, such as KeyMod apertures, one of which is labeled 316. Optionally, reinforcement liner 314 may include additional apertures, other than accessory-mounting apertures, around its perimeter to improve molding (by avoiding delamination) and reduce the weight of reinforcement liner 314.

Figure 3E:
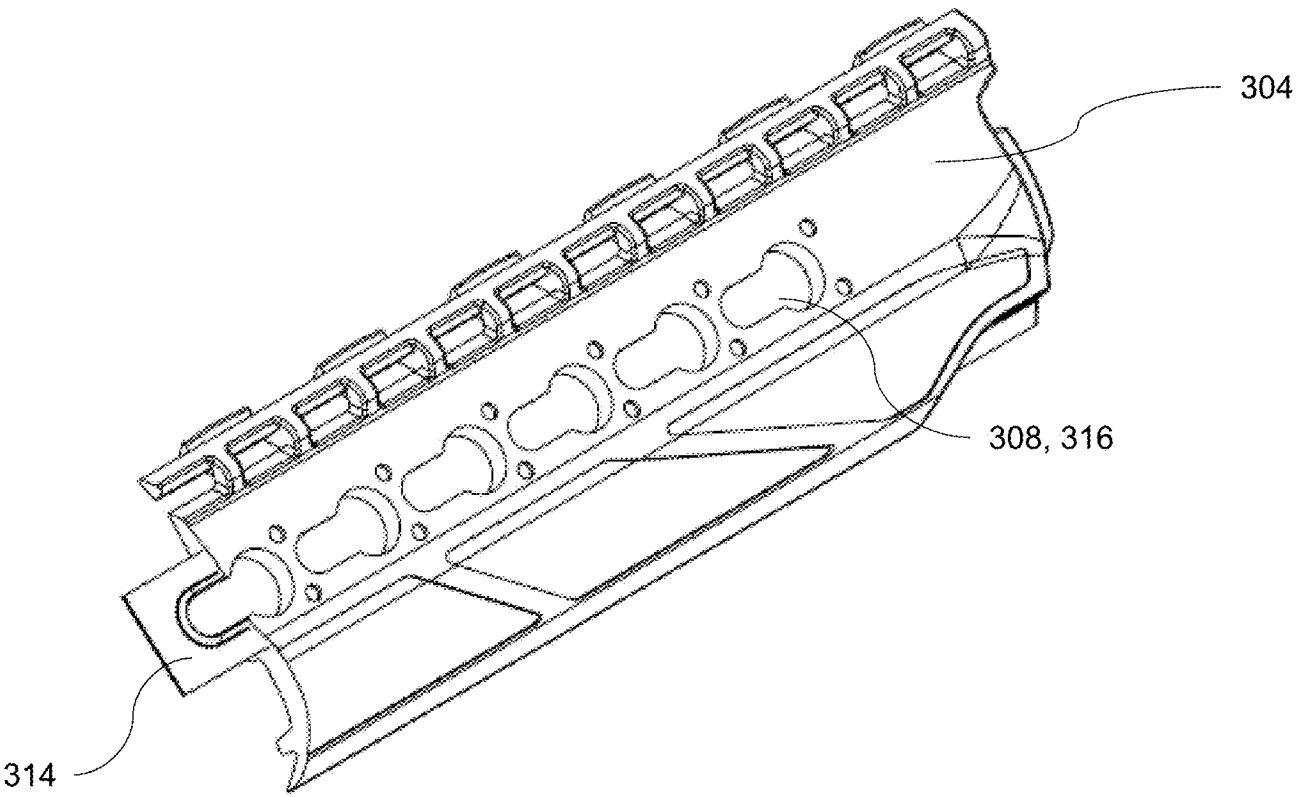
FIG. 3E illustrates a cutaway view of a side section with reinforcement liner of the handguard of FIG. 3A.

Referring now to FIG. 3E, a cutaway view of a side section with reinforcement liner of the handguard of FIG. 3A is shown. Reinforcement liner 314 is molded into second side section 304. Apertures 316 of reinforcement liner 314 align with KeyMod apertures 308.

Figure 3F:
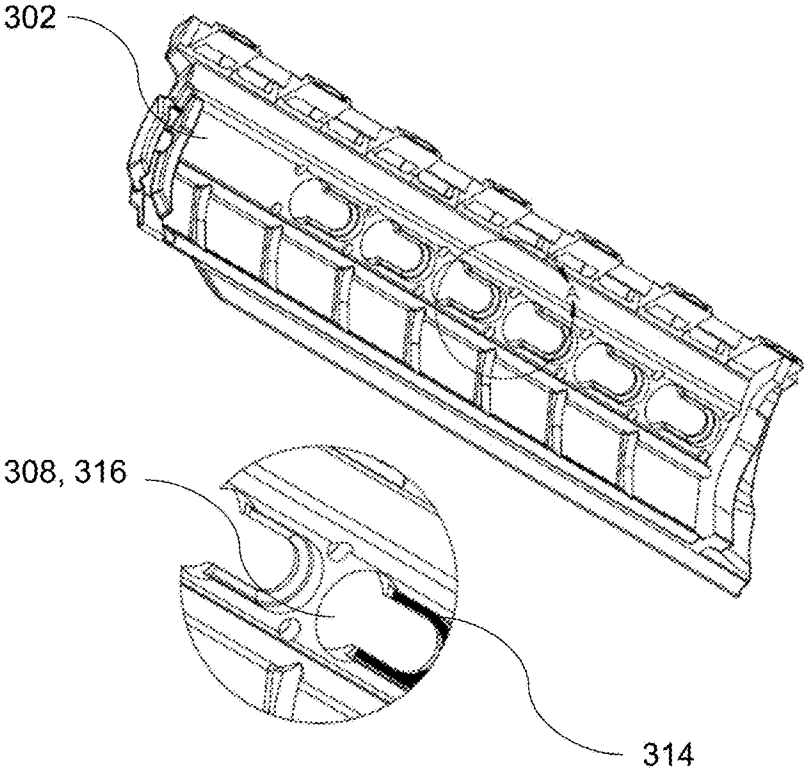
FIG. 3F illustrates a magnified view of an aperture of the handguard of FIG. 3A.

Referring now to FIG. 3F, a magnified view of an aperture of the handguard of FIG. 3A is shown. Reinforcement liner 314 (shaded) is shown in the exposed edges of KeyMod aperture 308, 316. Reinforcement liner 314 is shown in FIG. 3F as partially exposed on the interior of handguard 300 (closest to the barrel). However, it will be understood that reinforcement liner 314 could alternatively be partially exposed on the exterior of handguard 300. In yet another embodiment, no part of reinforcement liner 314 may be exposed.

Figure 3G:
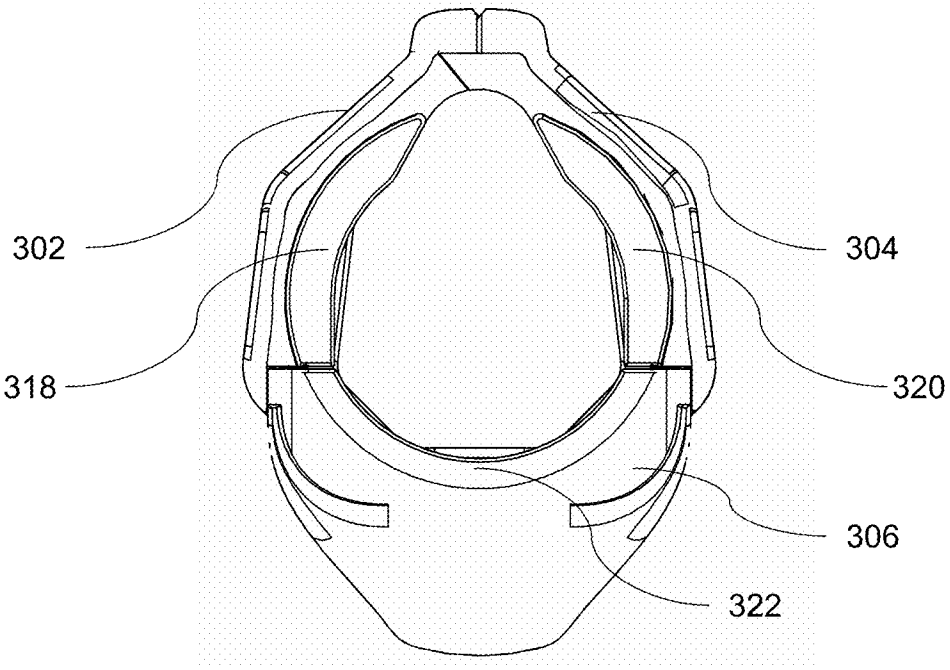
FIG. 3G illustrates a front view of the assembled handguard of FIG. 3A.

Referring now to FIG. 3G, a front view of the assembled handguard of FIG. 3A is shown. First section 302 and second section 304, in a locked position, may be mounted to bottom section 306 to complete handguard 300. Due to its triangulated structure, when handguard 300 is fully assembled and installed on a firearm (not shown, see FIG. 4), its strength rivals the strength of a one-piece handguard.

Figure 4:
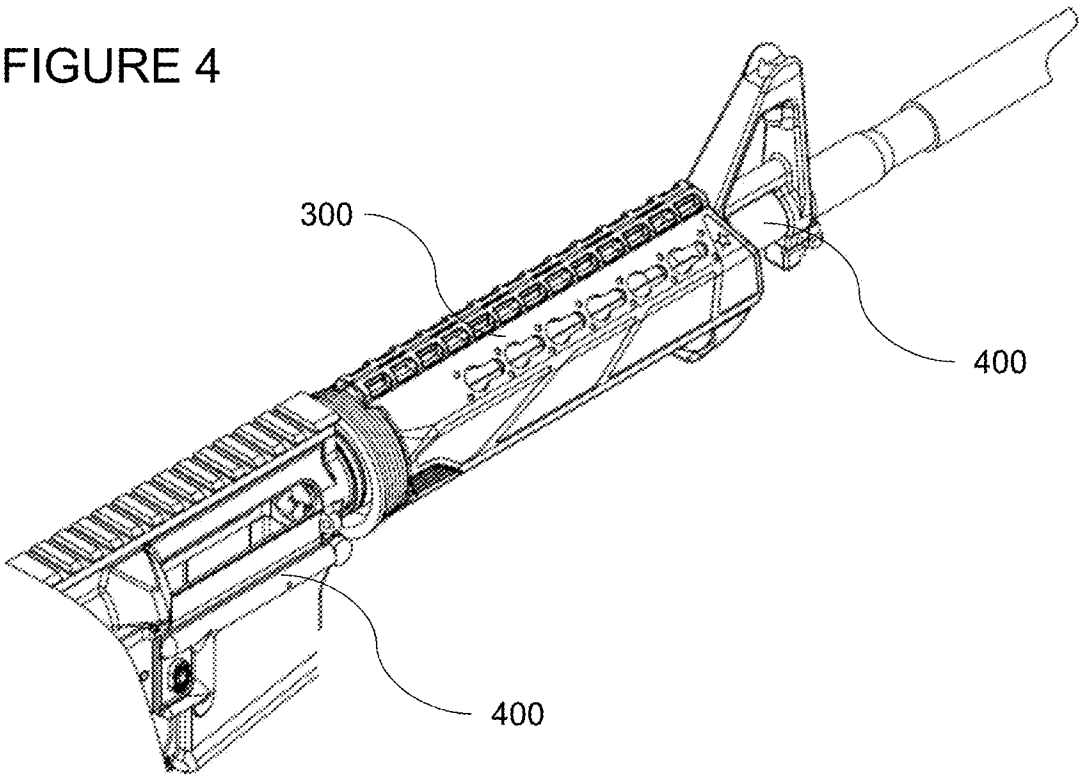
FIG. 4 illustrates a perspective view of the handguard of FIG. 3A on a cutaway view of an exemplary firearm.

Referring now to FIG. 4, a perspective view of the handguard of FIG. 3A on a cutaway view of an exemplary firearm is illustrated. Handguard 300 is fully assembled and mounted on an exemplary firearm 400. Firearm 400 may be an AR-10 with a carbine-length gas system or other firearms.

Figure 5:
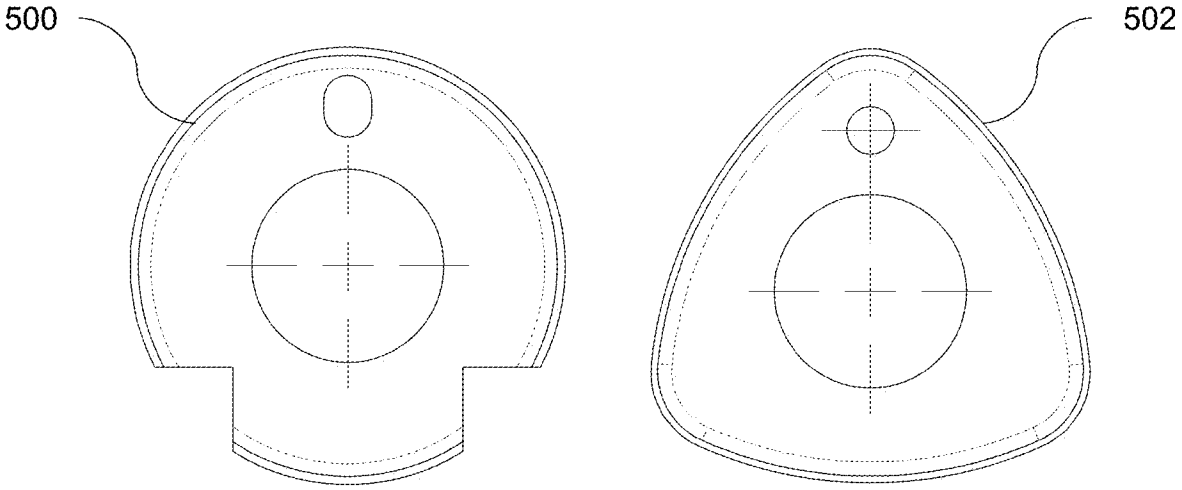
FIG. 5 illustrates front views of inserts for retaining caps for use with the handguard of FIG. 1A.

Referring now to FIG. 5, front views of inserts for retaining caps for use with the handguards of FIG. 1A and FIG. 3A are illustrated. The AR-15 uses two different forward handguard retaining caps, a round retaining cap 500 typically used on shorter (e.g., carbine-length) gas system handguards, such as handguard 300 of FIG. 3A, and a triangular retaining cap 502, typically used on longer (e.g., mid-length) gas system handguards, such as handguard 100 of FIG. 1A. Although round retaining caps are typically used on carbine-length gas systems and triangular retaining caps are traditionally used on mid-length gas systems, some manufacturers use both round retaining caps and triangular retaining caps on handguards for mid-length gas systems. First handguard insert 118, second handguard insert 120, and third handguard insert 122 may be optionally used with the front portion of handguard 100 (mid-length gas system handguard) (see, e.g., FIG. 1C)carbine-length gsh to allow the handguard to interface with round retaining cap 500. When not in use, the handguard will only interface with triangular retaining cap 502, if handguard was originally configured to interface with triangular retaining cap 502.

If needed, the front portion of handguard 300 (carbine-length gas system handguard) may also be made to accept first handguard insert 118, second handguard insert 120, and third handguard insert 122 to adapt to both style of handguard retaining caps 500 and 502.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A firearm handguard, the handguard comprising:
a first side section;
a second side section coupled to the first side section by a plurality of interlocking fingers; and
a bottom section coupled to the first side section and the second side section, wherein:
the first side section and the second side section each contain at least one accessory mounting aperture, and the first side section and the second side section are comprised of a polymer material, the polymer material having molded therein a reinforcement liner including at least one reinforcement aperture, and wherein the at least one accessory mounting aperture is aligned with the at least one reinforcement aperture.

2. The firearm handguard of claim 1, wherein the reinforcement liner is comprised of metal.

3. The firearm handguard of claim 2, wherein the metal is stainless steel.

4. The firearm handguard of claim 1, wherein the at least one accessory mounting aperture is a KeyMod aperture.

5. The firearm handguard of claim 1, further comprising a round handguard retaining cap.

6. The firearm handguard of claim 1, further comprising a Picatinny rail.

7. The firearm handguard of claim 1, wherein one of the first side section or the second side section additionally comprises at least one ventilation aperture.

8. The firearm handguard of claim 1, further comprising a heat shield coupled to the bottom section.

9. A firearm comprising:
an upper receiver; and
a handguard coupled to the upper receiver, the handguard comprising:
a first side section,
a second side section coupled to the first side section by a plurality of interlocking fingers, and
a bottom section coupled to the first side section and the second side section, and wherein:
the first side section and the second side section each contain at least one accessory mounting aperture, and the first side section and the second side section are comprised of a polymer material, the polymer material having molded therein a reinforcement liner including at least one reinforcement aperture, and wherein the at least one accessory mounting aperture is aligned with the at least one reinforcement aperture.

10. The firearm of claim 9, wherein the reinforcement liner is comprised of metal.

11. The firearm claim 10, wherein the metal is stainless steel.

12. The firearm of claim 9, wherein the at least one accessory mounting aperture is a KeyMod aperture.

13. The firearm of claim 9, wherein the firearm is an AR-10 with a carbine-length gas system.

14. The firearm of claim 9, wherein the firearm is an AR-15 with a mid-length gas system.

15. The firearm of claim 9, wherein the handguard further comprises a round handguard retaining cap.

16. The firearm of claim 9, wherein the handguard further comprises a Picatinny rail.

17. The firearm of claim 9, wherein one of the first side section or the second side section of the handguard additionally comprises at least one ventilation aperture.

18. The firearm of claim 9, wherein the handguard further comprises a heat shield coupled to the bottom section.

19. A firearm handguard, the handguard comprising:

a plurality of molded polymer sections;

wherein a first section includes a reinforcement liner molded into the polymer and an accessory mounting aperture;

wherein at least a portion of the reinforcement liner is not covered by the polymer and is exposed.

20. The firearm handguard of claim 19, wherein the reinforcement liner includes an aperture in the reinforcement liner aligned with the accessory mounting aperture.

21. The firearm handguard of claim 1, wherein at least a portion of the reinforcement liner is not covered by the polymer material and is exposed.

22. The firearm of claim 9, wherein at least a portion of the reinforcement liner is not covered by the polymer material and is exposed.

* * * * *